US006262947B1

(12) United States Patent
Pulver

(10) Patent No.: US 6,262,947 B1
(45) Date of Patent: Jul. 17, 2001

(54) TIMEPIECE WITH A CHANGEABLE DIAL FACE

(76) Inventor: Mark Pulver, 20 Avondale Rd., White Plains, NY (US) 10605

( * ) Notice: Subject to any disclaimer, the term of this patent is extended or adjusted under 35 U.S.C. 154(b) by 0 days.

(21) Appl. No.: 09/522,974

(22) Filed: Mar. 10, 2000

(51) Int. Cl.[7] ..... G04B 19/00; G04B 19/06

(52) U.S. Cl. ..... 368/223; 368/232

(58) Field of Search ..... 368/76, 80, 223, 368/228, 232, 233, 295

(56) References Cited

U.S. PATENT DOCUMENTS 4,660,992 * 4/1987 Paul et al. ..... 368/223
4,941,137 * 7/1990 Kikuchi ..... 368/223
5,161,130 * 11/1992 Sato et al. ..... 368/228
5,168,479 * 12/1992 Lima ..... 368/232

* cited by examiner

*Primary Examiner*—Vit Miska
(74) *Attorney, Agent, or Firm*—Bernard Malina; Malina & Wolson

(57) ABSTRACT

A timepiece includes a rotatable bezel mounted on the housing. A storage area inside the housing contains a plurality of folded or crumpled sector elements. The sector elements each have an apex which is attached to a curved spring-like wire and a base which is attached to the housing. Rotating the bezel causes detents in the bezel to push the wires out of the storage area and causes the wires and the sector elements to cover a conventional solid dial face which is mounted in the housing thereby changing the appearance of the dial face. The sector members may have various indicia formed thereon.

24 Claims, 4 Drawing Sheets

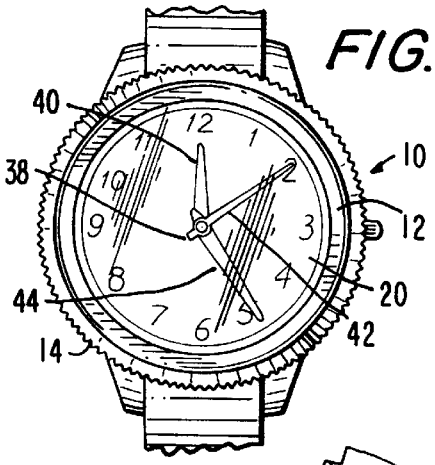
FIG. 1
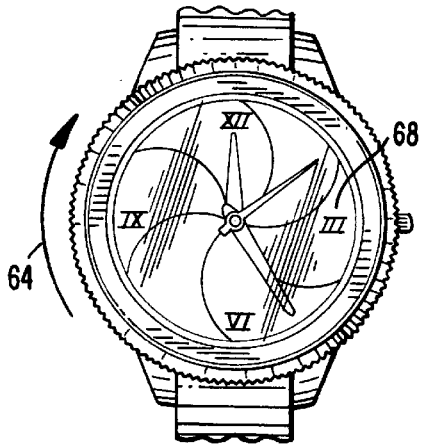
FIG. 4
FIG. 2
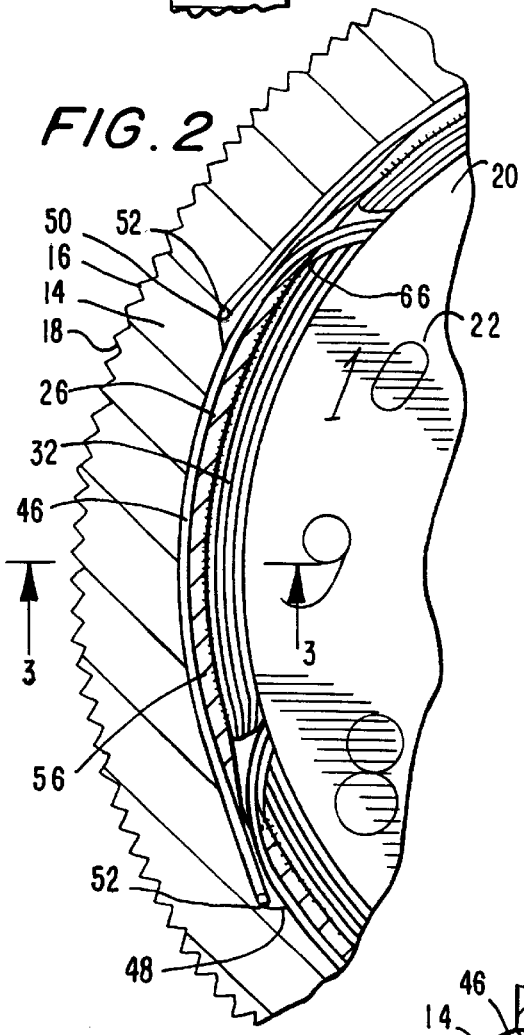
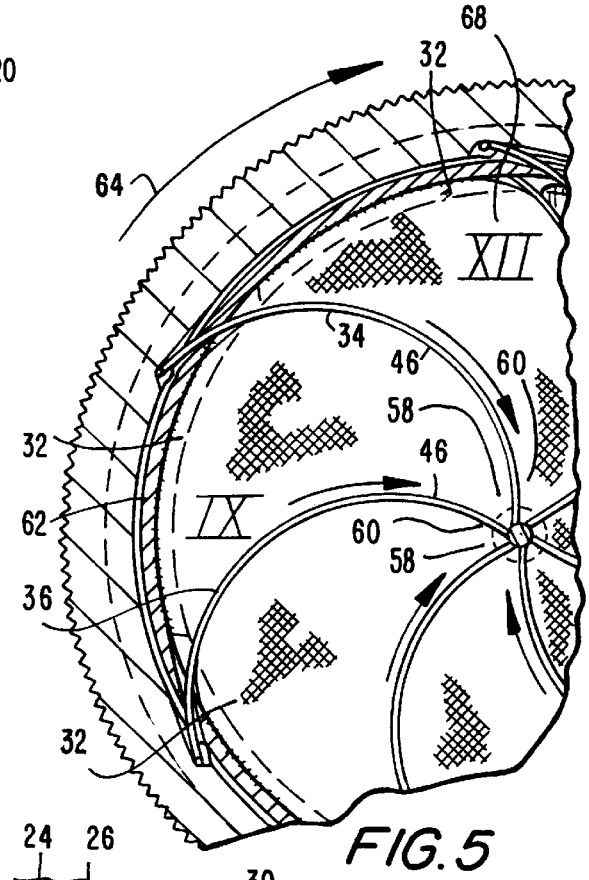
FIG. 5
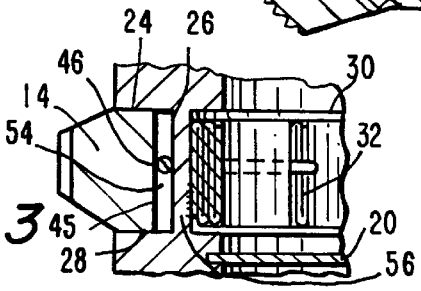
FIG. 3

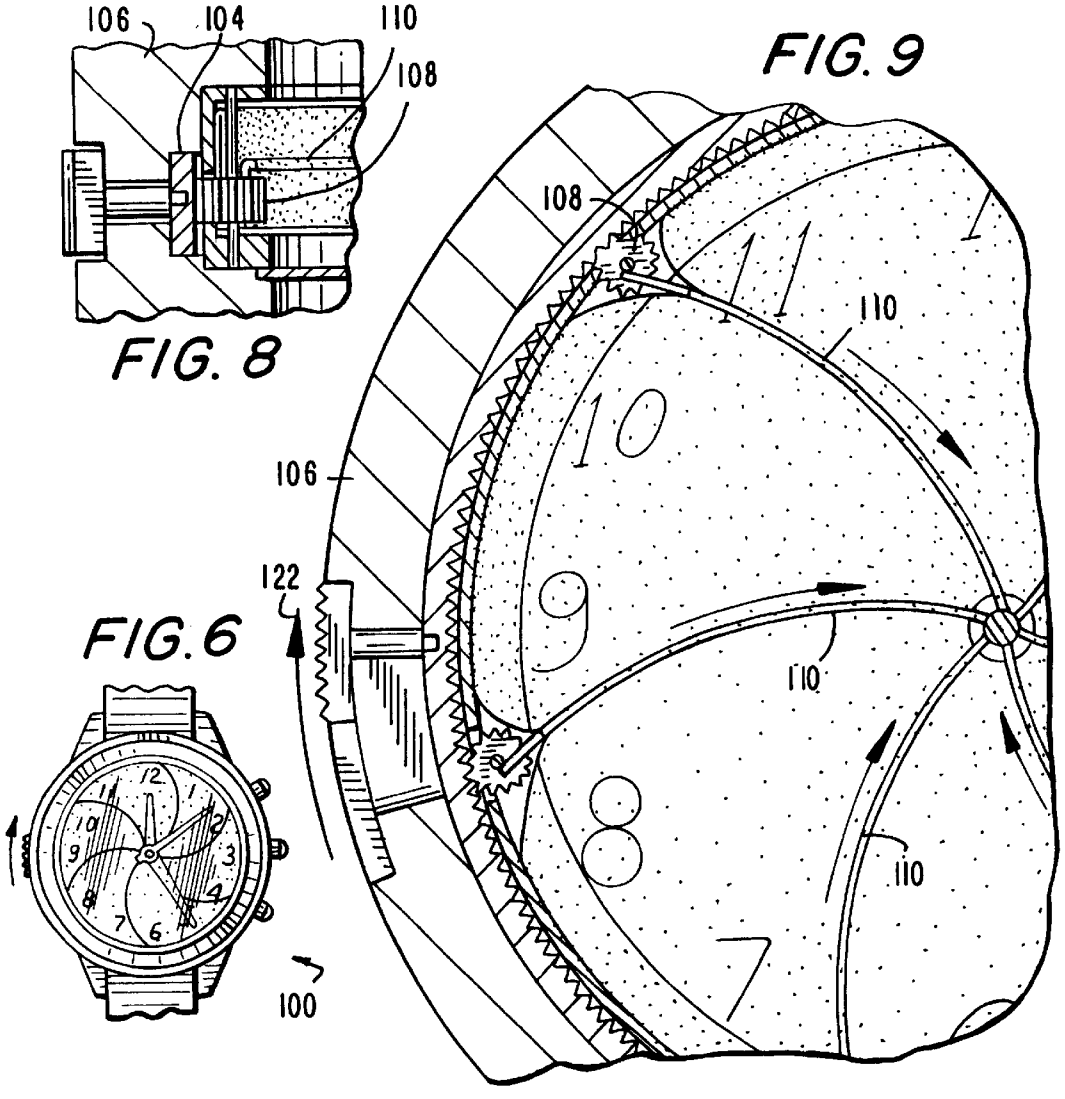
FIG. 8
FIG. 9
FIG. 6
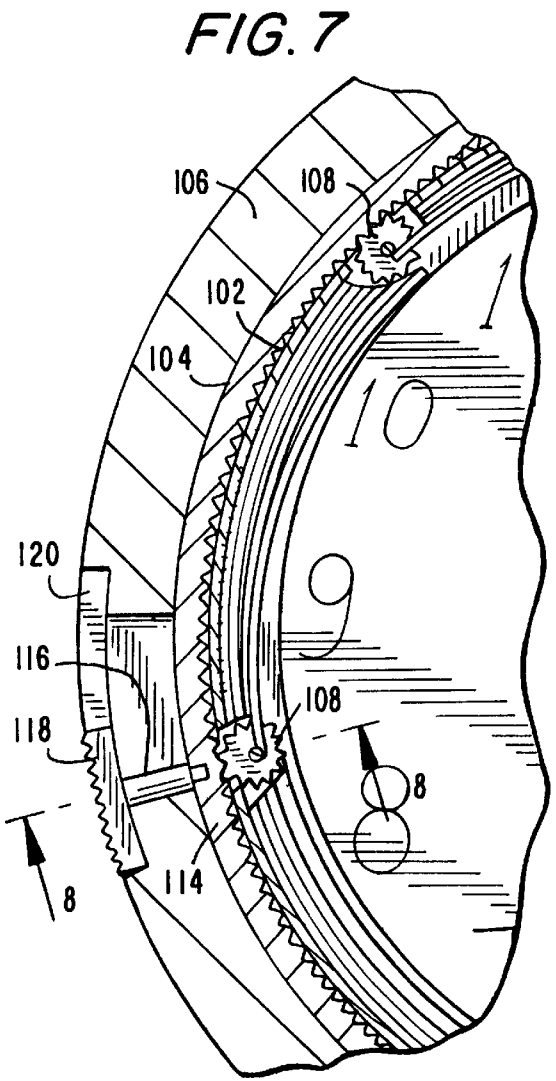
FIG. 7

300
320
330
328
312
310
308

318
302
324
304
322
316
314
332
306

326
326
314
308
330

TIMEPIECE WITH A CHANGEABLE DIAL FACE

BACKGROUND OF THE INVENTION

The present invention relates generally to the field of timepieces and more particularly, to a timepiece with a changeable dial face which can easily and conveniently alter the overall appearance of the timepiece.

THE PRIOR ART

The prior art related to timepieces includes the following United States Patents.

U.S. Pat. No. 5,161,130 to Sato et al. shows a clock with a pair of dial pieces which are laterally operably pivoted on a stationary shaft. In the closed position, the two dial pieces define a single time display face. When a driving motor is operated, the dial pieces are moved apart to an open position revealing a small group of statues which are normally hidden when the dial pieces are in the closed position.

U.S. Pat. No. 5,740,130 to Grupp et al. shows a timepiece in which a field-effect or charge-effect optical shutter allows a decorative design, which is placed against the backface of the timepiece, is uncovered or masked depending on the change of state of the optical shutter.

Despite the various developments in the prior art, there remains a need for a timepiece in which the dial face can be easily changed without resorting to electrical motors or electrical devices of any kind.

OBJECTS AND SUMMARY OF THE INVENTION

It is an object of the present invention to provide a timepiece with an easily changeable dial face.

Another object of the present invention is to provide a timepiece with a changeable dial face in which the dial face can be altered by rotating a bezel.

Another object of the present invention is to provide a timepiece with a changeable dial face in which the dial face can be altered by sliding a button.

Another object of the present invention is to provide a timepiece with a changeable dial face in which the dial face can be altered by pushing a button.

Another object of the present invention is to provide a timepiece having a plurality of changeable dial faces which are individually selectable.

Another object of the present invention is to provide a timepiece with a changeable dial face which can be manufactured in a wide range of sizes and styles.

Yet another object of the present invention is to provide a timepiece with a changeable dial face which comprises a relatively small number of component parts, each of which can be manufactured in volume at a relatively low cost resulting in a relatively low unit cost.

The foregoing and other objects and advantages of the present invention will appear more clearly hereinafter.

In accordance with the present invention, there is provided a timepiece with a changeable dial face which includes a rotatable bezel mounjited on the housing. A storage area inside the housing contains a plurality of folded or crumpled sector elements. The sector elements each have an apex which is attached to a curved spring-like wire and a base which is attached to the housing. Rotating the bezel causes elements in the bezel to push the wires out of the storage area and catises the wires and the sector elements to cover a conventional solid dial face which is mounted in the housing thereby changing the appearance of the dial face. The sector members may have various indicia formed thereon.

In alternative embodiments of the invention, the rotating bezel is replaced by a sliding button and/or by a push button.

In another alternative embodiment of the invention, multiple assemblies of wire members and sector elements are mounted one above the other and above a conventional dial face.

In yet another embodiment of the invention, the solid dial face and/or the housing are made of a transparent material.

DESCRIPTION OF THE DRAWINGS

Other important objects and advantages of the present invention will be apparent from the following detailed description taken in connection with the accompanying drawings in which:

FIG. 1 is an overall plan view of a timepiece with a changeable dial face made in accordance with the present invention.

FIG. 2 is a fragmentary plan view similar to FIG. 1 drawn to an enlarged scale and partially in section;

FIG. 3 is a cross-sectional view taken along the line 3—3 of FIG. 2;

FIG. 4 is a plan view similar to FIG. 2 with the bezel rotated to change the appearance of the dial face;

FIG. 5 is a fragmentary plan view similar to FIG. 4, drawn to an enlarged scale and partially in section;

FIG. 6 is an overall plan view of an alternative embodiment of the timepiece of FIG. 1 which incorporates a sliding activation button.

FIG. 7 is a fragmentary plan view similar to FIG. 6 drawn to an enlarged scale and partially in section;

FIG. 8 is a cross-sectional view taken along the line 8—8 in FIG. 7;

FIG. 9 is a fragmentary plan view similar to FIG. 7 showing the slide button moved to change the appearance of the dial face;

Figure 12:
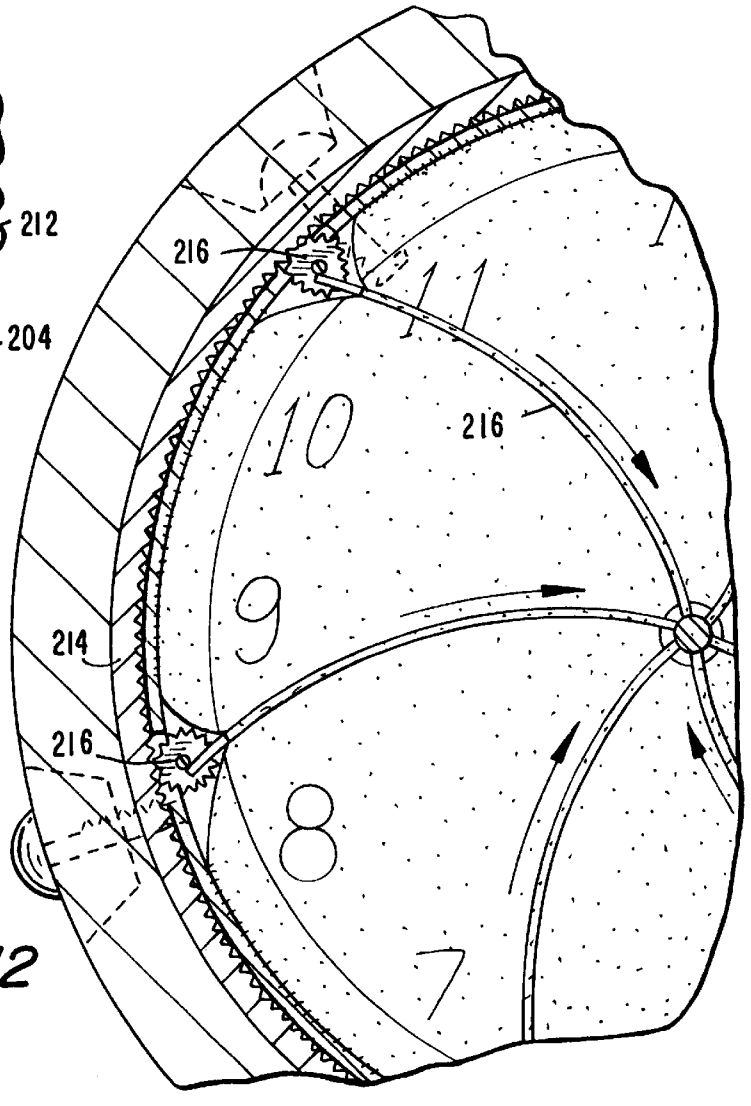
FIG. 12 is a fragmentary plan view, similar to FIG. 10, showing the push button moved to change the appearance of the dial face.

In accordance with the present invention, there is provided a timepiece with a changeable dial face which includes a housing which supports a rotatively mounted bezel. The inner surface of the bezel includes a series of detents which engage the outer ends of a series of preformed wire members which are stored in a storage area formed along the periphery of the housing. The inner ends of each of the wire members are connected to the tip of a flexible sector clement which is generally triangular in configuration with curved edges meeting at an apex and a curved base edge which conforms to the curvature of the housing. The base edge is secured to the housing by glue or other fastening means. In the folded state, the flexible sector elements are folded alongside the inner wall of the housing.

When it is desired to change the appearance of the timepiece, the bezel is rotated thereby driving the wire members out of the storage chamber and driving the wire members inwardly toward the central shaft of the timepiece which supports the hands.

The inner ends of the wire members drag the flexible sector elements to an unfolded or deployed state in which the flexible sector elements completely cover a conventional dial face which is mounted in the housing. The flexible sector elements include various iiidicia as desired and thereby reversibly alter the appearance of the timepiece.

In alternative embodiments of the invention the rotating bezel is replaced by a sliding button and/or by a push button.

In another alternate embodiment of the invention, multiple assemblies of wire members and flexible sector elements are mounted one above the other and above a conventional dial face. Each of the three assemblies is controlled by a push button and may be individually deployed thereby providing a range of alternative appearances for the timepiece.

DETAILED DESCRIPTION OF THE INVENTION

With reference to the drawings wherein like reference numbers designate like or corresponding parts throughout, there is shown in FIGS. 1–15, a timepiece with a changeable dial face 10 made in accordance with the present invention.

FIGS. 1–5 show the primary embodiment of the invention 10 in which the case or housing 12 of the timepiece has a bezel 14 rotatably mounted thereon.

The outer surface 16 of the bezel includes serrations to facilitate rotating the bezel 14. FIGS. 1 and 2 show a conventional dial face 20 which is mounted in the housing 12 in a conventional manner. By way of example, the dial face 20 includes the Arabic numerals 1–12 22.

As is shown in FIGS. 2 and 3, the bezel 14 is rotatably mounted between the surfaces 24, 26, 28 of the housing 12. The housing 12 includes an area 30 which contains a folded or crumpled plurality of flexible sector elements 32 which form a key feature of the present invention. Each of the sector elements 32 is defined by a pair of curved edges 34, 36 which form an apex 58 which is directed toward the central shaft 38 of the timepiece 10 which supports the hands 40, 42, 44. Each of the sector elements 32 has a preformed curved spring-like wire 46.

In the folded state shown in FIGS. 2 and 3, the sector elements 32 are shown in the area 30 which is located just above the conventional solid dial face 20. The inner surface 45 of the bezel 14 has a plurality of detents 48, 50 which engage ends 52 of the wires 46 which support the sector elements 32.

In the folded state shown in FIGS. 2 and 3, the wires 46 are disposed in a storage area 54 which is defined by the inner surface 45 of the bezel 14 and the wall 56 of the housing.

The apexes 58 of the flexible sector elements 32 are attached to the inner ends 60 of the wires 46. The base edge 62 of each of the flexible sector elements 32 are attached to the wall 56 of the housing 12 by an adhesive layer or other conventional attachment means.

Rotating the bezel 14 in the direction shown by the arrows 64 in FIGS. 3 and 4 causes the detents 48, 50 in the bezel 14 to push on the ends 52 of the wires 46 as shown in FIG. 4. This forces the wires 46 to move through apertures 66 in the housing 12 and move toward the central shaft 38 and thereby completely cover the conventional dial face 20 with the flexible sector elements 32. The sector elements 32 may include various indicia such as the Romanian numerals 68 shown in FIGS. 4 and 5.

Reversing the direction of rotation of the bezel 14 draws the sector elements 32 back into the folded state thus restoring the original appearance of the timepiece 10.

The sectors 32 thus cover and uncover the conventional dial face 20 and quickly and reversibly change the appearance of the timepiece 10 responsive to rotation of the bezel 14.

FIGS. 6–9 show a second embodiment 100 of the invention in which internal gear teeth 102 are formed on a ring gear 104 which is rotatably mounted in the housing 106. A plurality of pinions 108 are rotatably mounted in the housing 106. The pinion 108 are each in mesh with the ring gear 104. Each of the pinions 108 supports a curved wire 110 which is mounted in a generally radial orientation relative to the pinion 108.

The wires 110 support flexible sector elements 112 which are similar to the flexible sector elements 32 which have been previously described in connection with the primary embodiment of the invention 10 shown in FIGS. 1–5.

The outer surface 114 of the ring gear 104 supports a shaft 116 which includes a slide button 118 which slides within a recess 120 formed in the housing 106. Moving the slide button 118 in the direction shown by the arrow 122 in FIG. 9 from the position shown in FIG. 6 to the position shown in FIG. 9 rotates the pinions 108 thereby rotating the wires 110 to the position shown in FIG. 9 thereby covering the conventional dial with the flexible sector elements 32 in the manner which has been previously described and changing the appearance of the timepiece 100.

Figure 11:
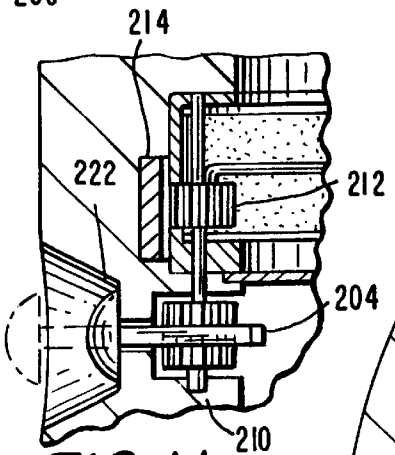
FIG. 11 is a fragmentary cross-sectional view taken along the line 11—11 of FIG. 10.
Figure 10:
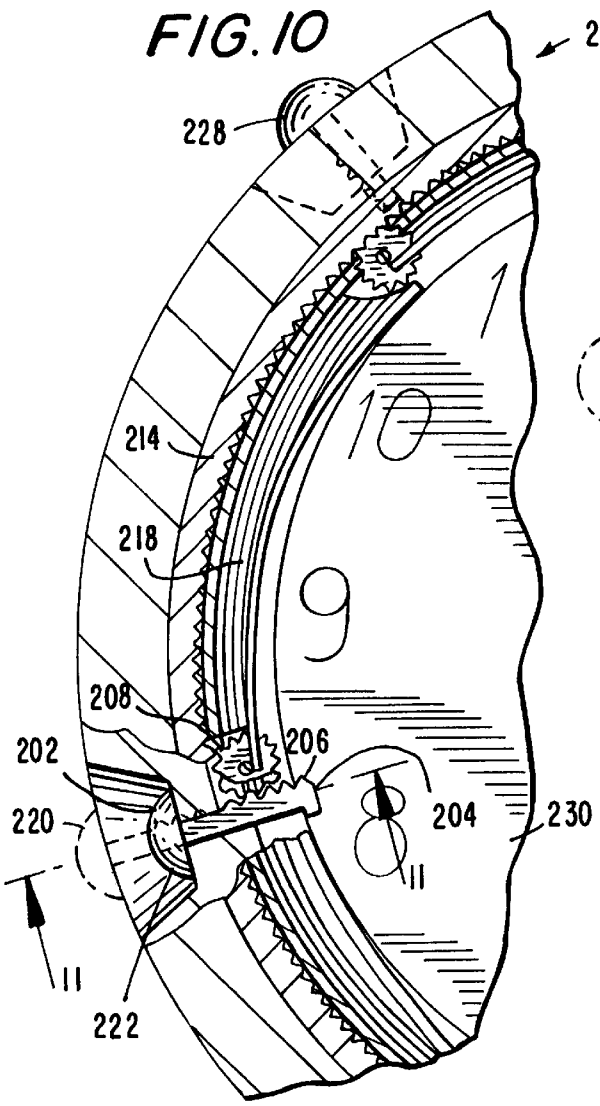
FIG. 10 is a fragmentary plan view partially in section of another alternative embodiment of the timepiece of FIG. 1 which incorporates a push button.

FIGS. 10–12 show a third embodiment of the invention 200 which is operated by a push-button 202. The push-button 202 is connected to a shaft 204 on which a plurality of rack teeth 206 are formed.

The rack teeth 206 are in mesh with a pinion 208 which is mounted on a shaft 210. As shown in FIG. 11, a gear 212 is mounted on the shaft 210 and the gear 212 is in mesh with the ring gear 214. The gear 212 is one of a plurality of identical gears 216 which are in mesh, with the ring gear 214. As has been previously described, a curved wire 216 is mounted on each of the gears 212, 216. The curved wires 216 support sector element 218 which have also been previously described.

Pushing the push-button 202 inwardly from the position shown in FIG. 11 in broken lines 220 to the position shown in solid lines 222 causing the gear 212 and the pinion 208 to rotate. This causes the ring gear 214 to rotate thereby rotating the gears 216 and moving the wires 216 to the folded position 224 shown in FIG. 10. The ring gear 214 also drives the push button 228 outwardly.

When the push button 228 is pushed inwardly, the curved wires 216 rotate to the open position shown in FIG. 12 and the sector elements 218 unfold and cover the dial face 230 changing the appearance of the timepiece 200. The push button 202 is driven outwardly as shown in FIG. 12 and is thus ready for the next operating cycle.

Figures 13, 14, 15:
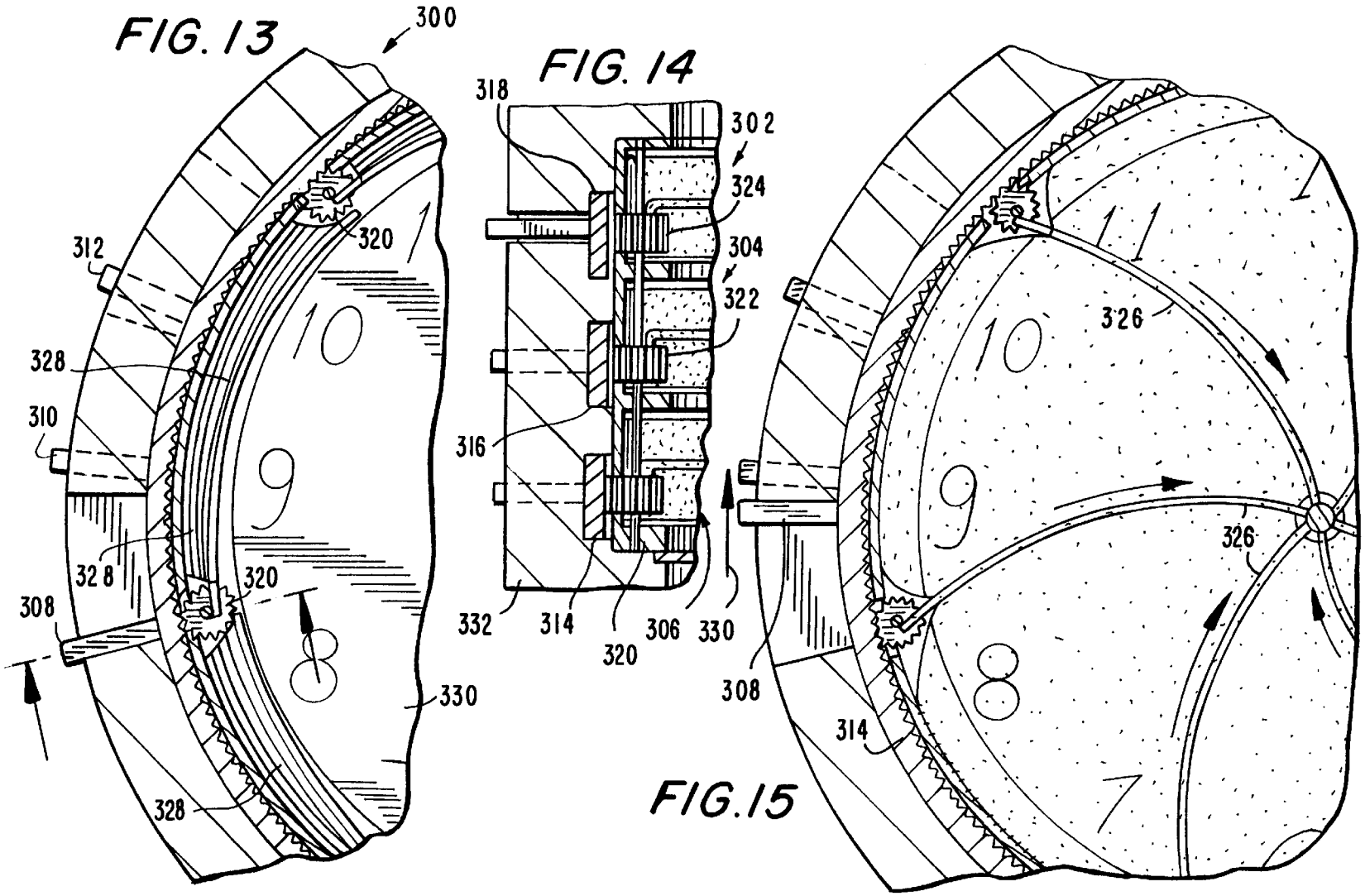
FIG. 13 is a fragmentary plan view, partially in section, of yet another alternative embodiment of the timepiece of FIG. 1 which incorporates those alternative dial faces in addition to a primary dial face.
FIG. 14 is a fragmentary cross-sectional view taken along the line 14—14 of FIG. 13.
FIG. 15 is a fragmentary plan view similar to FIG. 13 showing an activation button moved to change the appearance of the dial face.

FIGS. 13–15 shown a fourth embodiment 300 of the invention which incorporates three assemblies 302, 304, 306 which are each individually operated by a slide button 308, 310, 312. Each of the buttons 308, 310, 312 is mounted on a ring gear 314, 316, 318. The ring gears 314, 316, 318 are in mesh with a plurality of gears 320, 322, 324 which are mounted in the housing 332. As has been previously described, a curved wire 326 is mounted oin each of the gears 320, 322, 324 and the curved wires 326 support sector elements 328 which have also been previously described.

As is shown in FIGS. 14, 15, the slide button 308 can be moved in the direction shown by the arrow 330 in FIG. 15 thereby rotating the ring gear 314 and causing the curved wires 326 to rotate into the unfolded position. Each of the slide buttons 308, 310, 312 can be operated individually to reversibly move the wires 326 from a folded position shown in FIG. 13 to an unfolded position shown in FIG. 15.

The sector elements 328 which are part of the three assemblies 302, 304, 306 preferably have different indicia thereon thereby providing the user with three different alternative dial faces in addition to the conventional dial face 330.

In another group of alternative embodiments of the invention, which are not illustrated, the construction of the timepiece with changeable dial face is identical to any one of the four embodiments 10, 100, 200 and 300 as previously described with the exception that the conventional dial face 20 is replaced by a solid dial face which is made of a transparent material.

In yet another group of alternative embodiments which are also not illustrated, the housing 12 is made of a transparent material.

In each of the above embodiments, the flexible sector elements may be made of any one of a number of flexible materials including: fabric or textile materials, rubber-like materials or plastic film materials.

The foregoing specific embodiments of the present invention as set forth in the specification herein are for illustrative purposes only. Various deviations and modifications can be made within the spirit and scope of the invention, without departing from the main theme thereof.

What is claimed is:

1. A timepiece with a changeable dial face comprising:

a housing; and a plurality of display face sector elements movable within said housing between a retracted position and an extended position to form one display face.

2. A timepiece according to claim 1 including a second display face mounted in said housing.

3. A timepiece according to claim 2 wherein said display face sector elements are movable within said housing between said extended position to form said one display face and said retracted position retracting said one time display face and exposing said second time display face.

4. A timepiece according to claim 2 wherein said second time display face is in coaxial relationship with said one time display face.

5. A timepiece according to claim 4 wherein said second time display face is located in said housing coaxially below said first time display face.

6. A timepiece according to claim 1 wherein each of said movable sector elements form a substantially planar portion of said one time display face in the aforesaid extended position.

7. A timepiece according to claim 1 wherein said display face sector elements are stored within the timepiece housing in the retracted position.

8. A timepiece according to claim 2 wherein said second time display face comprises a plurality of laterally movable sector elements.

9. A timepiece according to claim 1 wherein said sector elements are made of flexible sheet material.

10. A timepiece according to claim 1 wherein said sector elements are made of fabric.

11. A timepiece according to claim 1 wherein said flexible sector elements are made of rubber-like material.

12. A timepiece according to claim 1 wherein said sector elements are made of plastic film material.

13. A timepiece according to claim 3 wherein said sector elements are made of textile material.

14. A timepiece according to claim 2 wherein said second display face comprises a plurality of sector elements movable between a retracted position and an extended position to form said second display face.

15. A timepiece according to claim 1 including a storage area in said housing for storing said sector elements in the retracted position.

16. A timepiece according to claim 1 wherein said sector elements comprise a surface portion having indicia therein.

17. A timepiece according to claim 9 including a storage area formed in said housing for storing said sector elements in the retracted position, with each flexible sector element having an apex portion and a base portion;

with said base portion of each of said sector elements connected to said housing; and actuator means mounted on said housing for moving said sector elements to and from said extended and retracted positions.

18. A timepiece according to claim 17 wherein said actuator means comprises a plurality of wire members with each of said wire members having a first end and a second end, with each of said first ends of said wire members connected to an apex of one of said plurality of sector elements; and said actuator means engaging said second ends of each of said wire members for the purpose of reversibly moving said wire members and said flexible sector elements from said retracted position in which said wire members and said flexible sector elements are disposed in said storage area and said extended position in which said flexible sector elements form said one dial face.

19. A timepiece according to claim 18 in which said actuator means comprises a bezel, with said bezel rotatably mounted on said housing.

20. A timepiece according to claim 18 in which said actuator means comprises:

a ring gear rotatably mounted in said housing;

a plurality of pinion gears rotatably mounted in said housing with each of said pinion gears disposed in mesh with said ring gear and with said second end of said wire members each mounted on a pinion gear.

21. A timepiece according to claim 20 further comprising:

a slide button mounted on said ring gear for rotation of said ring gear by a user.

22. A timepiece with changeable dial face as claimed in claim 20 further comprising:

a first rack member slide ably mounted on said housing with said first rack member having a first end;

a first push button mounted on said first end of said first rack member;

first drive pinion rotatably mounted in said housing and dispersed in mesh with said first rack;

first driving connectors connecting said first drive pinion and a selected one of said plurality of pinion gears for rotation of said ring gear responsive to movement of said first rack member.

23. A timepiece with a changeable dial face as claimed in claim 22 further comprising:

a second rack member slideably mounted on said housing with said second rack member having a first end;

a second push button mounted on said first end of said rack member;

a second drive pinion rotatably mounted in said housing and disposed in mesh with said second rack member;

second driving connections connecting said second drive pinion and a selected second one of said plurality of pinion gears for rotation of said ring gear responsive to movement of said second rack member.

24. A timepiece with changeable dial face comprising:

a housing;

a dial face mounted in said housing;

a plurality of selectable dial face assemblies mounted in said housing one above the other within said housing with each of said plurality of dial face assemblies comprising a plurality of sector elements movable laterally within said housing between an extended position defining a first time display face and retracted position exposing a second time display face.

* * * * *